US005629582A

United States Patent [19]

Dobbs

[11] Patent Number: 5,629,582

[45] Date of Patent: May 13, 1997

[54] THERMALLY STABLE ELECTRON GUN ARRANGEMENT WITH ELECTRICALLY NON-CONDUCTIVE SPACER MEMBERS

[75] Inventor: Richard J. Dobbs, Broomfield, United Kingdom

[73] Assignee: EEV Limited, Chelmsford, United Kingdom

[21] Appl. No.: 397,867

[22] Filed: Mar. 2, 1995

[30] Foreign Application Priority Data

Mar. 16, 1994 [GB] United Kingdom ..... 9405139

[51] Int. Cl.[6] ..... H01J 29/46

[52] U.S. Cl. ..... 313/456; 313/257; 313/270

[58] Field of Search ..... 313/456, 250, 313/237, 243, 257, 265, 292, 252, 284, 289, 417, 270, 441; 315/3.5

[56] References Cited

U.S. PATENT DOCUMENTS

| | | | |
|---|---|---|---|
| 3,963,955 | 6/1976 | Miram et al. | 313/441 |
| 3,983,446 | 9/1976 | Miram et al. | 313/456 |
| 4,156,160 | 5/1979 | Jackson | 313/292 |
| 4,387,320 | 6/1983 | Hoet | 313/348 |
| 4,748,369 | 5/1988 | Phillips et al. | 313/250 |
| 5,534,747 | 7/1996 | Carruthers | 313/456 |

FOREIGN PATENT DOCUMENTS

| | | | |
|---|---|---|---|
| 558429 | 1/1944 | United Kingdom . | |
| 655806 | 8/1951 | United Kingdom . | |
| 872170 | 7/1961 | United Kingdom . | |
| 1048635 | 11/1966 | United Kingdom | H01J 1/94 |

*Primary Examiner*—Michael Horabik
*Assistant Examiner*—Michael Day
*Attorney, Agent, or Firm*—Spencer & Frank

[57] ABSTRACT

An electron gun arrangement includes an electron gun having a longitudinal axis and including first and second electrodes longitudinally spaced apart for generating an electron beam in a longitudinal direction. A first support member supports the first electrode and includes a first slot arrangement presenting a first pair of surfaces longitudinally spaced apart. A second support member is longitudinally spaced apart from the first support member for supporting the second electrode and includes a second slot arrangement presenting a second pair of surfaces longitudinally spaced apart. The surface of the first pair of surfaces that is closer to the second support member constitutes a first clamping surface and the surface of the second pair of surfaces that is closer to the first support member constitutes a second clamping surface. Each of a plurality of spacer members made of electrically non-conductive material includes a first portion disposed in the first slot arrangement and abutting the first clamping surface and a second portion disposed in the second slot arrangement and abutting the second clamping surface for maintaining a distance in the longitudinal direction between the first and second clamping surfaces substantially constant and allowing movement between the respective support members in a direction transverse to the longitudinal axis due to differential thermal expansion.

19 Claims, 2 Drawing Sheets

THERMALLY STABLE ELECTRON GUN ARRANGEMENT WITH ELECTRICALLY NON-CONDUCTIVE SPACER MEMBERS

FIELD OF THE INVENTION

This invention relates to electron gun arrangements and more particularly, but not exclusively, to arrangements used in high frequency amplifying tubes.

BACKGROUND OF THE INVENTION

In electron gun assemblies used, for example, in inductive output tubes (IOTs) and klystrons, it is necessary for optimum performance to ensure that the component electrodes are precisely located relative to one another and are maintained in alignment throughout operation of the device. The electrodes must be aligned both in the longitudinal axial direction, that is, the direction of the electron beam path and also in the transverse direction.

As the temperature of a device changes when it is brought into operation, its dimensions also alter according to the coefficients of thermal expansion of the materials of which it is composed. Different materials may have widely differing thermal expansivities, leading to stresses within the device. In an electron gun, this can lead to distortion and even permanent damage to the structure, particularly where components are fragile and/or must be accurately positioned to very high tolerances.

The problem is particularly acute in high power tubes such as klystrons and IOTs, especially where a gridded electron gun is required in which spacing between the grid and cathode is critical.

SUMMARY OF THE INVENTION

The present invention seeks to provide an electron gun arrangement suitable for applications in which a relatively wide range of temperatures is experienced during use and for which accurate electrode spacings are required.

According to the invention there is provided an electron gun arrangement comprising: an electron gun having a longitudinal axis along which an electron beam is generated and including first and second electrodes spaced apart along the longitudinal axis in the direction of the electron beam path and supported by first and second support means respectively; and a plurality of spacer members of electrically non-conductive material, each member being located in slot means in part of the first and part of the second support means such that the axial spacing between the said parts is maintained substantially constant during use, and such that relative movement between the parts in a radial direction due to differential thermal expansion is allowed.

By using spacer means in accordance with the invention, the distance between the first and second support means, and hence the first and second electrodes may be fixed so that the axial spacing of the electrodes is maintained at a constant value during operation and radial alignment may be retained. The invention is particularly useful where the first electrode is a grid, particularly a grid of pyrolytic graphite and the second electrode is a cathode. However, it may also be used in connection with other electrodes of an electron gun arrangement, for example between two grids where implementation of the above arrangement may be required.

Preferably the spacer members are of ceramic material. In one advantageous embodiment of the invention, the spacer members are arranged coaxially about the longitudinal axis, and are typically equidistantly spaced apart from one another.

In one preferred embodiment, the spacer members comprise cylindrical elongate posts. These may be of any cross-sectional shape and conveniently have a circular cross-section and radially enlarged ends. In an advantageous arrangement, each of the spacer members has a substantially I-shaped cross section. However, they could be, for example, U-or C-shaped members in which the end arms are located in slots in the first and second support means and the joining middle section extends between them.

The slot means in the parts of the first and second support means could be a single slot in each part or one or both parts could include a plurality of slots. One slot may then accommodate one of the spacer members.

Where the first electrode is a grid, the first support means may include a plurality of fingers arranged to urge the grid against a surface of the first support means. This allows the grid to be held in sliding engagement with the first support means to allow for differential expansion in the transverse direction to the longitudinal axis. Alternatively, the fingers could be replaced by a single continuous circular flange arranged coaxially with the longitudinal axis.

The invention is particularly applicable to electron gun arrangements used in high frequency amplifying tubes such as klystrons and IOTs, especially those which are required to operate at high power levels and in which significant heating effects occur.

BRIEF DESCRIPTION OF DRAWINGS

Different examples for the implementation of the invention will now be described with reference to the accompanying drawings, in which.

DETAILED DESCRIPTION OF THE PREFERRED EMBODIMENTS

Figure 1:
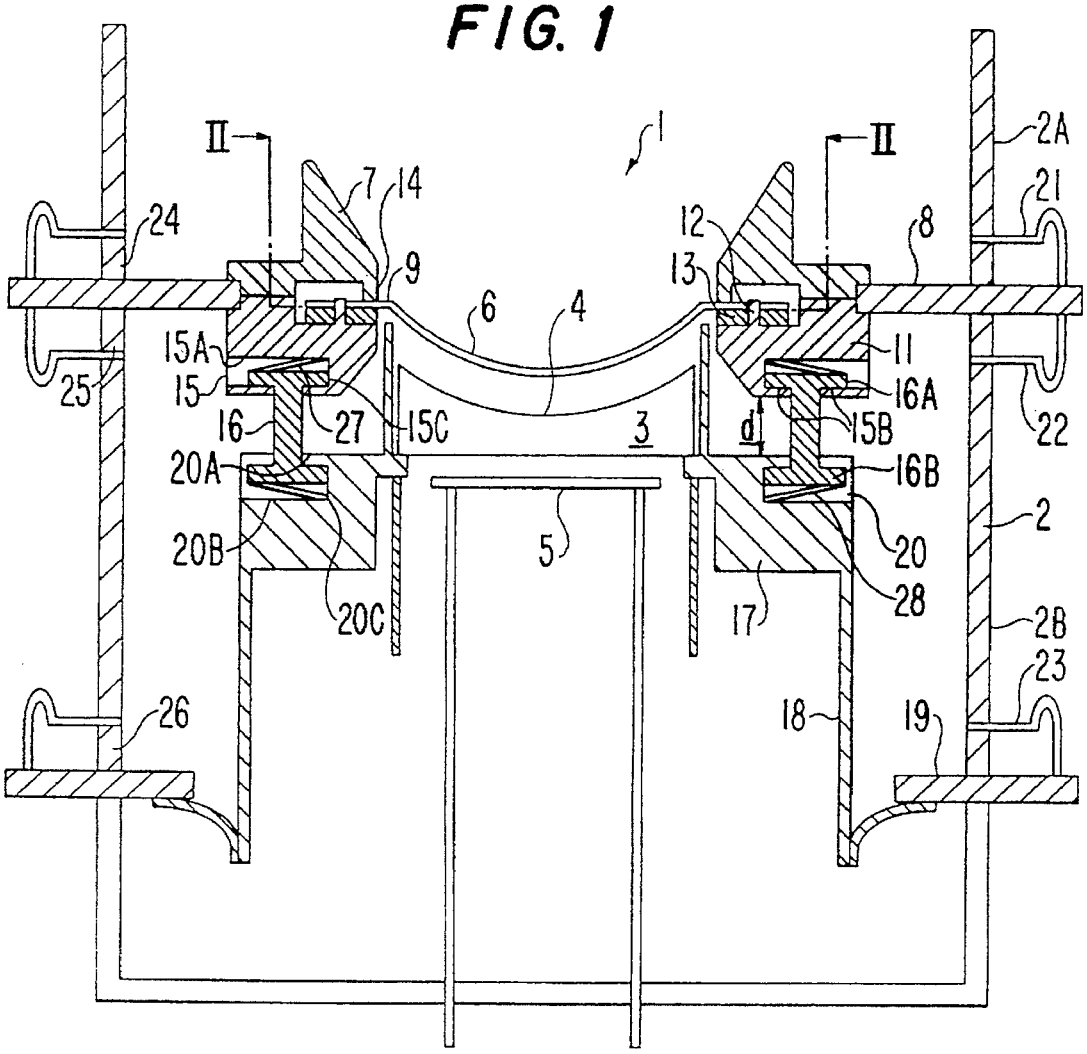
FIG. 1 is a schematic longitudinal section of part of a klystron including an electron gun arrangement in accordance with the invention.

With reference to FIG. 1, a klystron includes an electron gun indicated generally at 1 enclosed within a vacuum envelope 2. The electron gun includes a thermionic cathode 3 having a concave front emitting surface 4 with a heater filament 5 being located behind the cathode 3 and adjacent thereto. A mesh grid 6 of pyrolytic graphite is located in front of the emitting surface 4 of the cathode and has a similar profile to it such that the spacing between them is substantially uniform over the facing surfaces. A cylindrical focusing electrode 7 is located in front of the grid 6 and is in electrical contact therewith. A collector (not shown) is located at the far end of the tube and maintained at anode potential.

In operation, an electron beam is produced along the longitudinal axis X—X of the tube, being controlled by the potentials applied to the various electrodes included in the electron gun arrangement.

Figure 2:
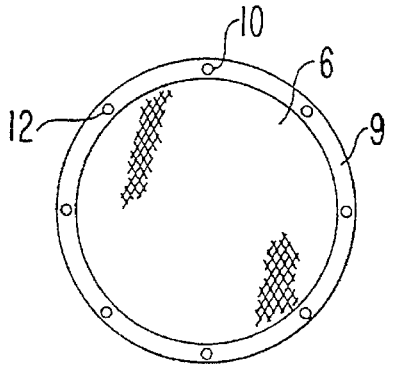
FIG. 2 is a transverse view of pan of the arrangement of FIG. 1 along the line II—II.

The focusing electrode 7, which is of stainless steel, is fixed to an annular copper support 8 having an outer diameter which is larger than that of the ceramic envelope 2 and which extends through the envelope wall to enable external electrical connections to be made thereto. The grid 6 includes an outer annular ring 9 having a plurality of apertures 10 therein located equidistantly around its circumference, as shown in FIG. 2. The grid 6 is supported by a grid support member 11 which is annular and of molybdenum, having a plurality of upstanding pins 12 arranged about its circumference which correspond in number and position with the apertures 10 in the periphery 9 of the grid 6. A carbon washer 13 is located between the grid 6 and grid support member 11. The grid 6 is contacted on its other surface by fingers 14 extensive from the inner periphery of the focusing electrode 7, the fingers 14 being located against the grid 6 to hold it in sliding engagement in a transverse direction. The apertures 10 in the periphery 9 and corresponding apertures in the washer 13 are larger than the diameter of the pins 12 in a radial direction to allow relative radial movement between the components.

The grid support 11 includes twelve slots 15 which have a rectangular longitudinal cross-section, with two surfaces 15A and 15B arranged to be substantially normal to the longitudinal axis X—X and a shorter inner joining wall 15 C joining them being substantially parallel to the above axis. The slots 15 are arranged in a common plane and are closed toward the inside region of the grid support member and open at the outer surface of the support 11. Twelve cylindrical ceramic posts 16 are located in the slots 15, with each slot accommodating a single post. The posts 16 are distributed equidistantly around the circumference of the grid support 11. Each post has a 'I' shaped longitudinal cross section which enlarged portions 16A and 16B at its ends.

For each post 16, the upper end 16A as illustrated is located in the slot 15 in the grid support member 11. It is located such that it abuts the radially inner boundary or joining wall 15C of the slot 15 and the back transverse surface 15B, that is, the transverse surface furthest from the periphery 9 of the grid 6, with a gap existing between the post 16 and the front transverse surface 15A, that is, the transverse surface nearest the periphery 9. It should be noted that the above arrangement is not shown to scale in FIG. 1 for the purposes of clarity.

The shaft of each post 16 is located in an aperture through the grid support 11 and extends rearwardly in a direction away from the cathode emitting surface 4.

An annular molybdenum ring support member 17 supports the cathode 3 and includes a rearwardly extensive tube 18 which is electrically connected to a copper annular plate 19 extensive of the vacuum envelope, permitting electrical connection to be made to the cathode 3. The cathode support 17 includes an inner shielding portion which is extensive around the cathode 3 and in front of it, and which is interposed between the inner rim of the grid support member 11 and the cathode 3.

The cathode support member 17 includes slots 20 extending in a radial direction and distributed around its circumference. Each slot 20 has three surfaces, two of which 20A and 20B are normal to the axis X—X, and the joining wall 20C being parallel to it, the slots being open at the outer surface of the support member 17. The ends 16B of the ceramic posts 16 are located in the slots 20. The enlarged end 16B of each post 16 abuts the front transverse surface 20A, that is the transverse surface nearest the grid support member 11, there being a gap between the end of the post and the back transverse surface 20B of the slot that is, the transverse surface furthest from the grid support member 11. The inner edge of the ceramic post 16 abuts the radially inner surface or joining wall 20C of the slot. The ceramic posts 16 are free to move in an outward radial direction at their ends 16B but fixed relative to the grid support member 11 at their other ends 16A.

The ceramic envelope 2 comprises two relatively long tubular sections 2A and 2B which are metallised and brazed to metallic annular flanges 21, 22 and 23 around the outside of the envelope 2. Ceramic balance rings 24, 25 and 26 are interposed between the metallic flanges 21, 22 and 23 and the annular copper plates 8 and 19.

Spring washers 27 and 28 are located in the slots 15 and 20 between the posts 16 and the grid and cathode support members 11 and 17 so as to urge the posts 16 against the transverse surfaces 15B and 20A.

As shown, the tube is in its non-operative state. During operation, the temperature increases and the lengths of the components of the electron gun change accordingly. The fingers 14 permit the grid 6 to move relative to the grid support member 11 whilst keeping it centrally located. The ceramic posts 16 ensure that transverse alignment between the grid member 11 and the cathode support member 17 is retained. Also, as the ends 16A and 16B of the ceramic posts 16 are arranged to abut transverse surfaces 15B and 20A of the slots 15 and 20 in which they are located, the spacing between the grid support member 11 and cathode support member 17, shown as d, is maintained at the same distance and hence the spacing between the grid 6 and cathode 3 is also maintained at a predetermined value at which optimum performance is achieved.

Figure 3:
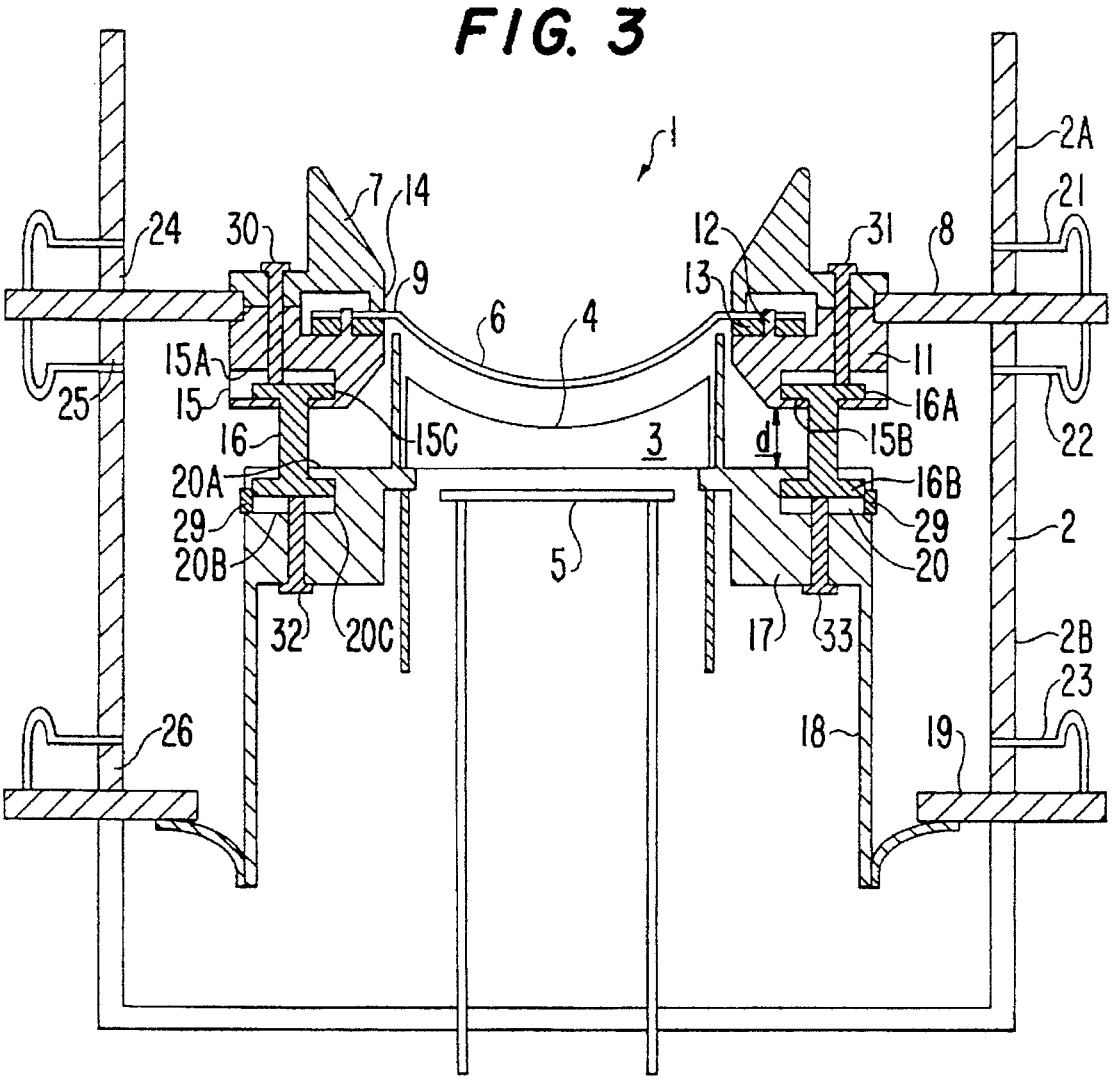
FIG. 3 schematically illustrates another embodiment of the invention, with like references being used for like pans.

In the arrangement shown in FIG. 1, the ends 16A of the posts are fixed relative to the grid support member 11. However, in another embodiment, illustrated in FIG. 3, the ends 16A are not constrained but the ends 16B located in slots in the cathode support member 17 are radially constrained by stops 29. Also, in this arrangement, the spring washers are replaced by screws 30 to 33 to hold the mating surfaces of the posts 16 and support members 11 and 17 together.

In another arrangement, not shown, both ends of the posts 16 are free to move in a radial outward direction.

The illustrated embodiments employ a plurality of slots in both the cathode and anode support members with pan of each post being located in a respective slot in each of the support members. In an alternative arrangement, the slots may be configured such that two or more posts are located in each one. There may be a single continuous slot around one or both of the support members in which the spacer members are located.

I claim:

1. An electron gun arrangement comprising:

an electron gun having a longitudinal axis and including first and second electrodes spaced apart from one another along the longitudinal axis for generating an electron beam in a direction of the longitudinal axis;

a first electrode support means for supporting the first electrode and including first slot means presenting a first pair of surfaces spaced apart from one another in the direction of the longitudinal axis;

a second electrode support means spaced apart from the first electrode support means in the direction of the longitudinal axis for supporting the second electrode and including second slot means presenting a second pair of surfaces spaced apart from one another in the direction of the longitudinal axis, the surface of the first pair of surfaces that is closer to the second electrode support means constituting a first clamping surface and the surface of the second pair of surfaces that is closer to the first electrode support means constituting a second clamping surface;

a plurality of spacer members made of electrically non-conductive material, each spacer member including a first portion disposed in the first slot means and abutting the first clamping surface and a second portion disposed in the second slot means and abutting the second clamping surface for maintaining a distance in the direction of the longitudinal axis between the first and second clamping surfaces substantially constant and allowing movement between the respective support means in a direction transverse to the longitudinal axis due to differential thermal expansion.

2. The arrangement according to claim 1, wherein the first electrode is a grid.

3. The arrangement according to claim 2, wherein the grid is made of pyrolytic graphite.

4. The arrangement according to claim 1, wherein the second electrode is a cathode.

5. The arrangement according to claim 1, wherein at least one of the spacer members is made of a ceramic material.

6. The arrangement according to claim 1, wherein the spacer members are spaced, in a plane transverse to the longitudinal axis, equidistantly with respect to one another along a circle whose center lies on the longitudinal axis.

7. The arrangement according to claim 1, wherein at least one of the first pair of surfaces and the second pair of surfaces are parallel to one another and lie in planes substantially transverse to the longitudinal axis, the arrangement further comprising a joining wall joining the at least one of the first pair of surfaces and the second pair of surfaces and lying in a plane substantially parallel to the longitudinal axis.

8. The arrangement according to claim 1, wherein the spacer members comprise cylindrical elongate posts.

9. The arrangement according to claim 8, wherein the first and second portions of the space members lay in planes substantially transverse to the longitudinal axis, the portions being configured to engage with respective ones of the first clamping surface and the second clamping surface.

10. The arrangement according to claim 9, wherein each of the spacer members has a substantially "T" shaped longitudinal cross section including a central shaft disposed between the first and second portions and oriented in a direction substantially parallel to the longitudinal axis.

11. The arrangement according to claim 1, wherein the spacer members are disposed in the first slot means and the second slot means such that their movement is constrained in a direction transverse to the longitudinal axis at one of the first slot means and the second slot means.

12. The arrangement according to claim 1, wherein:

the surface of the first pair of surfaces that is further from the second electrode support means constitutes a first urging surface;

the surface of the second pair of surfaces that is further from the first electrode support means constitutes a second urging surface; and the arrangement further comprises a plurality of resiliently deformable means, each resiliently deformable means being located in one of:

the first slot means between the first urging surface and a corresponding spacer member for urging the spacer member against the first clamping surface; and the second slot means between the second urging surface and a corresponding spacer member for urging the spacer member against the second clamping surface.

13. The arrangement according to claim 12, wherein each resiliently deformable means is a spring washer.

14. The arrangement according to claim 1, wherein:

the first electrode is a grid; and the first electrode support means and the first electrode are configured to hold the first electrode in sliding engagement with the first electrode support means such that the first electrode may move relative the first electrode support means in a direction transverse to the longitudinal axis.

15. The arrangement according to claim 14, wherein:

the grid defines a plurality of apertures about a periphery thereof; and the first electrode support means include a plurality of pins at a back portion thereof which engage respective apertures in the grid.

16. The arrangement according to claim 14, wherein the first support means includes a plurality of fingers at a front portion thereof which urge the grid against the back portion of the first support means.

17. The arrangement according to claim 16, wherein the first support means includes an annular washer disposed between the grid and the back portion of the first support means.

18. The arrangement according to claim 1, wherein:

at least one of the first slot means and the second slot means comprise a plurality of slots; and each spacer member is disposed in a respective one of the slots.

19. The arrangement according to claim 1, wherein the arrangement is a high frequency amplifying tube.

* * * * *